US011852063B1

(12) United States Patent
Khaled et al.

(10) Patent No.: US 11,852,063 B1
(45) Date of Patent: Dec. 26, 2023

(54) INTERNAL COMBUSTION ENGINE SYSTEMS INCLUDING INTERMITTENT SORBENT USAGE FOR EMISSION REDUCTION

(71) Applicant: Saudi Arabian Oil Company, Dhahran (SA)

(72) Inventors: Fethi Khaled, Al-Khobar (SA); Fakhar Mehmood, Dhahran (SA); Christos Kalamaras, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/065,236

(22) Filed: Dec. 13, 2022

(51) Int. Cl.
*F01N 3/10* (2006.01)
*F01N 3/20* (2006.01)
*F01N 3/08* (2006.01)

(52) U.S. Cl.
CPC ..... *F01N 3/105* (2013.01); *F01N 3/2013* (2013.01); *F01N 3/2033* (2013.01); *F01N 3/2046* (2013.01); *F01N 3/0878* (2013.01); *F01N 2240/02* (2013.01); *F01N 2260/04* (2013.01); *F01N 2370/04* (2013.01)

(58) Field of Classification Search
CPC ..... F01N 3/105; F01N 3/2013; F01N 3/2033; F01N 3/2046; F01N 3/0878; F01N 2240/02; F01N 2260/04; F01N 2370/04
See application file for complete search history.

(56) References Cited

U.S. PATENT DOCUMENTS 5,613,359 A * 3/1997 Zahn ..... F01N 13/009 60/284
5,850,734 A 12/1998 Ketcham
5,979,157 A * 11/1999 Kinugasa ..... F01N 3/2026 60/288
6,089,014 A * 7/2000 Day ..... F02M 26/15 422/171
11,187,124 B2 11/2021 Hamad
2009/0183498 A1* 7/2009 Uchida ..... F01N 13/009 60/299

(Continued)

*Primary Examiner* — Brandon D Lee
(74) *Attorney, Agent, or Firm* — DINSMORE & SHOHL LLP

(57) ABSTRACT

A method for operating an internal combustion engine includes combusting fuel and air within a combustion chamber of an internal combustion engine, thereby forming an exhaust gas, passing the exhaust gas out of the combustion chamber, and performing a startup procedure, the startup procedure including passing the exhaust gas from the combustion chamber through a first aftertreatment system to a pollutant capture unit, capturing criteria pollutants of the exhaust gas with the pollutant capture unit, and heating the first aftertreatment system to a first activation temperature. Subsequent to heating the first aftertreatment system to the first activation temperature a secondary procedure is performed including passing the exhaust gas from the combustion chamber directly to a second aftertreatment system bypassing the pollutant capture unit to heat the second aftertreatment system to a second activation temperature. Subsequently, exhaust gas is passed through the pollutant capture unit to desorb captured criteria pollutants.

18 Claims, 10 Drawing Sheets

(56) References Cited

U.S. PATENT DOCUMENTS

| | | | | |
|---|---|---|---|---|
| 2011/0083426 | A1* | 4/2011 | Ikemoto | F01P 7/165 60/297 |
| 2012/0036850 | A1* | 2/2012 | Ernst | F01N 13/0097 60/287 |
| 2013/0269326 | A1* | 10/2013 | Degen | F01N 13/017 60/297 |
| 2021/0207511 | A1* | 7/2021 | Hamad | F01N 3/103 |

* cited by examiner

INTERNAL COMBUSTION ENGINE SYSTEMS INCLUDING INTERMITTENT SORBENT USAGE FOR EMISSION REDUCTION

BACKGROUND

Field

The present disclosure relates to internal combustion engine systems including features for mitigating the release of criteria pollutants, and more particularly, to internal combustion engine systems including intermittent usage of sorbent material for mitigating the release of criteria pollutants.

Technical Background

Petroleum-based fuels are used to power the vast majority of vehicles. For example, gasoline, diesel fuel, and natural gas are relatively inexpensive and widely available for users, and are utilized to power internal combustion engines of vehicles throughout the world. However, the combustion of petroleum-based fuels may release pollutants into the environment, which may be undesirable for a number of reasons. Further, some pollutants released by the combustion of petroleum-based fuels are designated as "criteria pollutants," subject to regulation by various jurisdictions. As other cleaner sources of energy for use with transportation vehicles may be too costly and underdeveloped, internal combustion engines are needed which can operate with reduced emission of criteria pollutants.

BRIEF SUMMARY

One strategy for reducing the emission of criteria pollutants includes the utilization of aftertreatment systems. For example, some aftertreatment systems may include a catalyst or catalysts that react with criteria pollutants to reduce undesirable emissions, commonly known as a catalytic converter. However, the effectiveness of the catalysts may depend at least partially on the temperature of the catalysts, and the catalysts may need to reach an operating temperature to effectively react with criteria pollutants. In some operating conditions, such as during engine startup, the catalysts of aftertreatment systems may be below the operating temperature, and the performance of the aftertreatment systems may be decreased, leading to increased criteria pollutant emission.

Accordingly, a need exists for improved internal combustion engine systems that reduce the emission of criteria pollutants. Embodiments of the present disclosure are directed to internal combustion engine systems that include two aftertreatment systems and a pollutant capture unit that is structurally configured to capture one or more criteria pollutants. Exhaust gas is routed through a first aftertreatment system enroute to the pollutant capture unit before being passed to a second aftertreatment system during a startup procedure. Passage through the first aftertreatment system initially expedites heating of the first aftertreatment system. Subsequent passage of the exhaust gas to the pollutant capture unit allows the pollutant capture unit to capture criteria pollutants as the aftertreatment systems are heated to an operating temperature. In this way the emission of criteria pollutants during startup conditions may be minimized with capture of the criteria pollutants in the pollutant capture unit until at least one of the aftertreatment systems are at operating temperature.

In one embodiment, a method for operating an internal combustion engine includes combusting a fuel and air mixture within a combustion chamber of an internal combustion engine, thereby forming an exhaust gas; passing the exhaust gas out of the combustion chamber; and performing a startup procedure. The startup procedure comprises passing the exhaust gas from the combustion chamber to a first aftertreatment system comprising one or more catalysts, passing the exhaust gas from the first aftertreatment system to a pollutant capture unit comprising one or more sorbent materials, capturing one or more criteria pollutants of the exhaust gas with the pollutant capture unit, passing the exhaust gas from the pollutant capture unit to a second aftertreatment system comprising one or more catalysts, where the one or more catalysts in the first aftertreatment system may be the same or different from the one or more catalysts in the second aftertreatment system, and heating the first aftertreatment system to a first activation temperature with the exhaust gas from the combustion chamber. The method further includes, subsequent to heating the first aftertreatment system to the first activation temperature, performing a secondary procedure, the secondary procedure comprising: passing the exhaust gas from the first aftertreatment system directly to the second aftertreatment system without passage through the pollutant capture unit, and heating the second aftertreatment system to a second activation temperature with the exhaust gas from the first aftertreatment system. The method further includes, subsequent to heating the second aftertreatment system to the second activation temperature, performing a tertiary procedure, the tertiary procedure comprising: splitting the exhaust gas from the first aftertreatment system into a first stream and a second stream, passing the first stream of the exhaust gas from the first aftertreatment system through the pollutant capture unit to raise the temperature of the sorbent above a desorption temperature for a regeneration period to release the criteria pollutants captured in the pollutant capture unit, and passing the second stream of the exhaust gas from the first aftertreatment system and the exhaust gas from the pollutant capture unit to the second aftertreatment system. The one or more catalysts of the first aftertreatment system upon reaching the first activation temperature and the one or more catalysts of the second aftertreatment system upon reaching the second activation temperature react with criteria pollutants of the exhaust gas, thereby forming a treated exhaust gas, wherein the treated exhaust gas comprises less criteria pollutants than the exhaust gas from the combustion chamber.

In another embodiment, an internal combustion engine system includes a combustion chamber; a pollutant capture unit in selective communication with the combustion chamber, wherein the pollutant capture unit comprises one or more sorbent materials structurally configured to capture one or more criteria pollutants in a gas passing through the pollutant capture unit; a first aftertreatment system comprising one or more catalysts in communication with the combustion chamber and in selective communication with the pollutant capture unit, wherein the first aftertreatment system is structurally configured to react with one or more criteria pollutants in a gas passing through the first aftertreatment system; a second aftertreatment system comprising one or more catalysts in selective communication with the pollutant capture unit and the first aftertreatment system, wherein the second aftertreatment system is structurally configured to react with one or more criteria pollutants in a gas passing through the second aftertreatment system, and wherein the one or more catalysts in the first aftertreatment system may be the same or different from the one or more catalysts in the second aftertreatment system; an emission treatment selector valve positioned between the first aftertreatment system and the pollutant capture unit and between the first aftertreatment system and the second aftertreatment system, wherein the emission treatment selector valve is repositionable between a pollutant capture position, in which the first aftertreatment system and the pollutant capture unit are in communication with one another through the emission treatment selector valve, and a bypass position, in which the first aftertreatment system is in communication with the second aftertreatment system through the emission treatment selector valve; and a controller communicatively coupled to the emission treatment selector valve. The controller includes a processor and a computer readable and executable instruction set, which when executed, causes the processor to: execute a startup procedure, the startup procedure comprising: directing the emission treatment selector valve into the pollutant capture position, thereby directing exhaust gas from the first aftertreatment system to the pollutant capture unit; execute a secondary procedure, the secondary procedure comprising: directing the emission treatment selector valve into the bypass position, thereby directing exhaust gas from the first aftertreatment system to the second aftertreatment system bypassing the pollutant capture unit; and execute a tertiary procedure, the tertiary procedure comprising: directing the emission treatment selector valve to direct the exhaust gas from the first aftertreatment system at least partially to the pollutant capture unit to raise the temperature of the sorbent materials above a desorption temperature to release the criteria pollutants captured in the pollutant capture unit.

Additional features and advantages of the technology disclosed in this disclosure will be set forth in the detailed description which follows, and in part will be readily apparent to those skilled in the art from the description or recognized by practicing the technology as described in this disclosure, including the detailed description which follows, the claims, as well as the appended drawings.

BRIEF DESCRIPTION OF THE DRAWINGS

The following detailed description of specific embodiments of the present disclosure can be best understood when read in conjunction with the following drawings, where like structure is indicated with like reference numerals and in which.

Reference will now be made in greater detail to various embodiments, some embodiments of which are illustrated in the accompanying drawings. Whenever possible, the same reference numerals will be used throughout the drawings to refer to the same or similar parts.

DETAILED DESCRIPTION

Embodiments described herein are generally directed to internal combustion engine systems and methods for operating internal combustion engine systems that mitigate the emission of criteria pollutants. In embodiments described herein, internal combustion engine systems include a first aftertreatment system, a second aftertreatment system, and a pollutant capture unit that are in selective communication with a combustion chamber. During startup conditions, exhaust gas is routed to the pollutant capture unit, which captures criteria pollutants from the exhaust gas while the first aftertreatment system is heated to an activation temperature. Once the first aftertreatment system is heated to the activation temperature, exhaust gas from the combustion chamber is routed directly through the second aftertreatment system. By preferentially routing exhaust gas to pollutant capture unit during startup, criteria pollutants that would otherwise be emitted from the internal combustion engine to the environment while the first aftertreatment system and the second aftermarket treatment system are heated to the activation temperature or temperatures are captured. These and other embodiments of internal combustion engine systems that mitigate criteria pollutant emission are disclosed in greater detail herein with reference to the appended figures.

Figure 1:
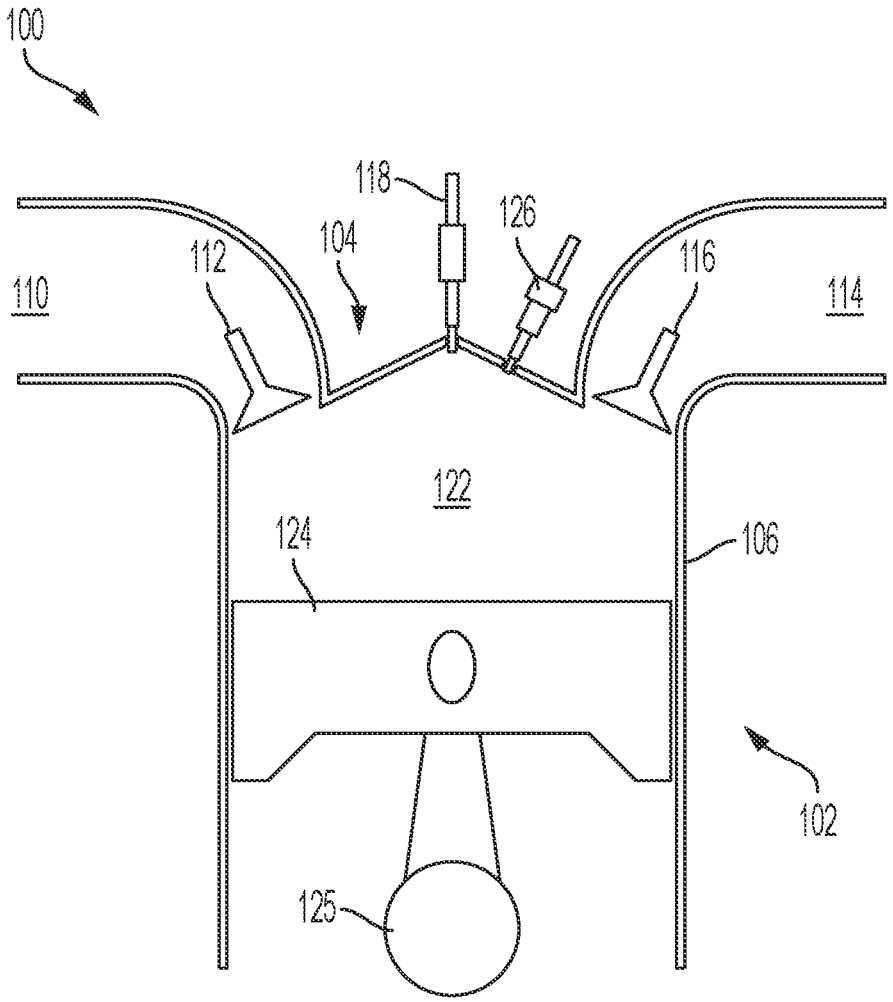
FIG. 1 schematically depicts a section view of an internal combustion engine of an internal combustion engine system, according to one or more embodiments shown and described herein.

Now referring to FIG. 1, a section view of an internal combustion engine 102 of an internal combustion engine system 100 is schematically depicted. While the method for operating an internal combustion engine and internal combustion engine system of the present disclosure are broadly applicable to various internal combustion engine designs, selected internal combustion engine configurations are provided to fully disclose and explain the present methods and systems. The internal combustion engine 102 generally includes a cylinder head 104 engaged with a block that defines one or more sidewalls 106 that are engaged with the cylinder head 104. In embodiments, a piston 124 is engaged with the one or more sidewalls 106, and the piston 124, the cylinder head 104, and the one or more sidewalls 106 at least partially define a combustion chamber 122 in which fuel is combusted. In embodiments, the piston 124 is movable along the one or more sidewalls 106, for example, as fuel is combusted within the combustion chamber 122.

In embodiments, the piston 124 is coupled to a crankshaft 125. For example in the embodiment depicted in FIG. 1, the piston 124 is coupled to the crankshaft 125 through a connecting rod, and in operation, linear movement of the piston 124 along the one or more sidewalls 106 is converted into rotational movement of the crankshaft 125. In embodiments in which the internal combustion engine 102 is the engine of a vehicle, rotational movement of the crankshaft 125 may drive a wheel or wheels of the vehicle to provide the vehicle with mobility. In some embodiments, such as embodiments in which the internal combustion engine 102 is part of a power generation system, the crankshaft 125 may drive a generator that produces electrical current.

In embodiments, the internal combustion engine system 100 includes an intake valve 112 and an exhaust valve 116. The intake valve 112 and the exhaust valve 116 are each repositionable between an open position and a closed position, and can be moved between the open position and the closed position by any suitable device, such as and without limitation, a cam shaft or the like. Through selective movement of the intake valve 112, the combustion chamber 122 is in selective communication with an engine intake 110. In embodiments, the engine intake 110 may be an intake manifold or the like through which intake gas, such as air, is passed into the combustion chamber 122. In some embodiments, pressurized gas may be provided to the engine intake 110, such as through a turbocharger or supercharger, however, in some embodiments, the intake gas provided to the engine intake 110 is provided at an ambient pressure.

Through selective movement of the exhaust valve 116, the combustion chamber 122 is in selective communication with an engine exhaust 114. In some embodiments, the engine exhaust 114 may be an exhaust manifold or the like through which exhaust gas comprising the combustion by-products from the combustion chamber 122 are passed after fuel is combusted within the combustion chamber 122. While in the embodiment depicted in FIG. 1, the internal combustion engine system 100 includes a single intake valve 112 and a single exhaust valve 116 in communication with the combustion chamber 122, it should be understood that this is merely an example, and embodiments described herein may include any suitable number of intake valves and exhaust valves in communication with the combustion chamber 122.

In embodiments, the internal combustion engine 102 includes a fuel injector 118 and an ignition device 120 in communication with the combustion chamber 122. The fuel injector 118 generally passes fuel, such as gasoline or the like, into the combustion chamber 122. In embodiments, the fuel injector 118 may include a multi-hole injector, a hollow cone injector, a piezo or solenoid-driven fuel injector, or the like.

The ignition device 120 may include a spark plug or the like that is operable to ignite or assist igniting fuel within the combustion chamber 122. While in the embodiment depicted in FIG. 1 the internal combustion engine 102 includes the ignition device 120, it should be understood that this is merely an example. For example, in some embodiments the internal combustion engine 102 may be a spark-ignition engine, and the ignition device 120 may ignite a fuel such as gasoline within the combustion chamber 122. However, in some embodiments, the internal combustion engine 102 may be a compression-ignition engine that may or may not include an ignition device, and may operate using a fuel such as gasoline, diesel fuel, natural gas, or the like.

While in the section view shown in FIG. 1, a single combustion chamber 122 is schematically depicted, it should be understood that the internal combustion engine 102 may include any suitable number of combustion chambers 122. Further, while in the embodiment depicted in FIG. 1, the internal combustion engine 102 includes the fuel injector 118 that is in direct communication with the combustion chamber 122, it should be understood that this is merely an example, and fuel can be indirectly passed into the combustion chamber 122, for example through the engine intake 110.

Figure 2:
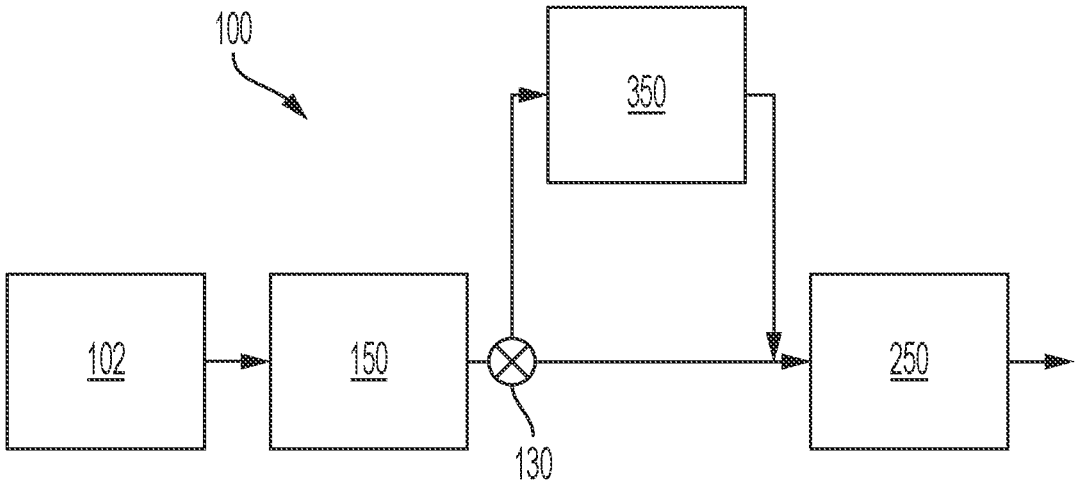
FIG. 2 schematically depicts a process flow of an internal combustion engine system, according to one or more embodiments shown and described herein.

Referring to FIG. 2, a schematic view of one or more embodiments of the internal combustion engine system 100 is depicted. In embodiments, the internal combustion engine system 100 includes a first aftertreatment system 150, a second aftertreatment system 250, and a pollutant capture unit 350 that are in selective communication with the internal combustion engine 102.

In embodiments, the first aftertreatment system 150 is structurally configured to react with one or more criteria pollutants in a gas, such as exhaust gas, passing through the first aftertreatment system 150. In particular, the first aftertreatment system 150 includes one or more catalysts that react with one or more criteria pollutants, chemically converting the criteria pollutants to components that are not designated as criteria pollutants. In one or more embodiments, the first aftertreatment system 150 may be a close-coupled catalytic converter as presently implemented in vehicles.

In embodiments, the second aftertreatment system 250 is structurally configured to react with one or more criteria pollutants in a gas, such as exhaust gas, passing through the second aftertreatment system 250. In particular, the second aftertreatment system 250 includes one or more catalysts that react with one or more criteria pollutants, chemically converting the criteria pollutants to components that are not designated as criteria pollutants. The one or more catalysts in the second aftertreatment system 250 may be the same or different from the one or more catalysts in the first aftertreatment system 150. In one or more embodiments, the second aftertreatment system 250 may be an underfloor catalytic converter as presently implemented in vehicles.

As referred to herein, the term "criteria pollutants" includes pollutants that may be regulated by one or more jurisdictions and includes at least one of carbon monoxide (CO), nitrogen oxides ($NO_x$), unburnt hydrocarbons (HCs), and their combinations.

In some embodiments, for example in embodiments in which the internal combustion engine 102 is a spark-ignition engine, the one or more catalysts that react with one or more criteria pollutants may include a three-way catalyst that is structurally configured to react with CO, $NO_x$, and HCs. For example, the three-way catalyst may convert CO into carbon dioxide ($CO_2$), may convert $NO_x$ into diatomic nitrogen ($N_2$) and water ($H_2O$), and may convert HCs into $H_2O$ and $CO_2$. In some embodiments, for example, in embodiments in which the internal combustion engine 102 is a compression-ignition engine such as a diesel engine, the one or more catalysts that react with one or more criteria pollutants may include a diesel oxidation catalyst (DOC) and a $NO_x$ reduction catalyst or catalyst system. In embodiments, the DOC may convert CO into $CO_2$ and convert HCs into $H_2O$ and $CO_2$, while the $NO_x$ reduction catalyst converts $NO_x$ into $H_2O$ and $N_2$. In some embodiments, the $NO_x$ reduction catalyst may include lean $NO_x$ catalysts, such as a copper substituted zeolite ZSM-5 catalyst, a platinum/alumina catalyst, or and their combination. In some embodiments, the $NO_x$ reduction catalyst may include a selective catalyst reduction (SCR) system.

In embodiments, the first aftertreatment system 150 defines a "light-off" or first activation temperature that corresponds to a minimum temperature at which a desired amount of criteria pollutants are converted within the first aftertreatment system 150. In some embodiments, the first activation temperature of the first aftertreatment system 150 is about 300 degrees Celsius (° C.). In various further embodiments, the first activation temperature of the first aftertreatment system 150 is in the range of about 175° C. to about 450° C., about 250° C. to about 450° C., about 300° C. to about 450° C., or about 300° C. to about 400° C. In some embodiments, the first activation temperature of the first aftertreatment system 150 is about 400° C. For example, a three-way catalyst in accordance with $Al_2O_3/CeO_2/ZrO_2$ mixed oxide palladium (Pd) Catalyst with an additional rhodium (Rh) component, commercially available from Johnson Matthey (London, England), may light-off at about 300° C.

In embodiments, the second aftertreatment system 250 defines a "light-off" or second activation temperature that corresponds to a minimum temperature at which a desired amount of criteria pollutants are converted within the second aftertreatment system 250. In some embodiments, the second activation temperature of the second aftertreatment system 250 is about 300° C. In various further embodiments, the second activation temperature of the second aftertreatment system 250 is in the range of about 175° C. to about 450° C., about 250° C. to about 450° C., about 300° C. to about 450° C., or about 300° C. to about 400° C. In some embodiments, the second activation temperature of the second aftertreatment system 250 is about 400° C.

In one or more embodiments, the "light-off" or first activation temperature of the first aftertreatment system 150 and the "light-off" or second activation temperature of the second aftertreatment system 250 are substantially the same.

In one or more embodiments, the "light-off" or first activation temperature of the first aftertreatment system 150 and the "light-off" or second activation temperature of the second aftertreatment system 250 are different. It will be appreciated that a lesser activation temperature may be achieved more swiftly compared to a greater activation temperature thus allowing the aftertreatment system to provide criteria pollutant mitigation quicker.

In one or more embodiments, the first aftertreatment system 150 is quicker to light off and the second aftertreatment system 250 has a better conversion efficiency. It will be appreciated that the first aftertreatment system 150 may be configured to have quicker light off than the second aftertreatment system 250 by utilizing a smaller total volume of catalyst or using a catalyst which has a lesser activation temperature than the catalyst of the second aftertreatment system 250. Further, the second aftertreatment system 250 may be designed for better conversion efficiency by utilizing more catalyst or selected catalysts which are optimized for the particular criteria pollutants and operating conditions of the internal combustion engine system 100.

The pollutant capture unit 350 is structurally configured to capture one or more criteria pollutants in a gas, such as exhaust gas, passing through the pollutant capture unit 350. For example, in some embodiments, the pollutant capture unit 350 comprises one or more structures and materials that adsorb one or more criteria pollutants. In embodiments, the pollutant capture unit 350 may include sorbent materials such as activated carbons, zeolites, metal organic frameworks, silica, alumina, metal oxides, surface modified sorbents or liquids supported on porous material, barium oxide, or the like. In embodiments, the pollutant capture unit 350 may include the sorbent materials, for example, as a coating on a monolithic structure or as particles retained in a bed. A vacuum pressure may be maintained or applied to the pollutant capture unit 350 in some embodiments. For example, in some embodiments, the internal combustion engine 102 is in fluid communication with the pollutant capture unit 350, such as via the engine intake 110 (FIG. 1), and can apply a vacuum pressure to the pollutant capture unit 350 under some operating conditions. In some embodiments, a vacuum pump or the like is in communication with the pollutant capture unit 350 and can apply a vacuum pressure to the pollutant capture unit 350. As described in greater detail herein, the application of a vacuum pressure to the pollutant capture unit 350 can aid the release of criteria pollutants from the pollutant capture unit 350.

In some embodiments, the pollutant capture unit 350 may include different materials, different regions, or both different materials and different regions that are structurally configured to capture different criteria pollutants. For example, in some embodiments, the pollutant capture unit 350 includes zeolites for capturing HCs and CO, activated carbons for capturing HCs, or both zeolites and activated carbons at comparatively low temperatures. In some embodiments, the pollutant capture unit 350 includes barium oxide for capturing $NO_x$.

In embodiments, the pollutant capture unit 350 may adsorb criteria pollutants at comparatively low operating temperatures as compared to the activation temperatures of the first aftertreatment system 150 and the second aftertreatment system 250. For example in some embodiments, the pollutant capture unit 350 adsorbs criteria pollutants at temperatures less than 220° C. In some embodiments, the pollutant capture unit 350 adsorbs criteria pollutants at temperatures between 0° C. and 220° C., inclusive of the endpoints. In some embodiments, the pollutant capture unit 350 adsorbs criteria pollutants at temperatures between negative 20° C. and 220° C., inclusive of the endpoints. Because the pollutant capture unit 350 can adsorb criteria pollutants at comparatively low operating temperatures, the pollutant capture unit 350 can capture criteria pollutants while the first aftertreatment system 150, and subsequently the second aftertreatment system 250, heat to an operating temperature during a startup procedure, as described in greater detail herein.

In embodiments, the pollutant capture unit 350 desorbs criteria pollutants, thereby regenerating the pollutant capture unit 350 when the pollutant capture unit 350 is at temperatures exceeding a desorption temperature. As referred to herein, "desorption temperature" refers to a temperature of the pollutant capture unit 350 beyond which at least one of the criteria pollutants, such as CO, HCs, and $NO_x$, adsorbed by the pollutant capture unit 350 starts to be released from the pollutant capture unit 350. Without being bound by theory, sorbents of the pollutant capture unit 350 may have an adsorption isotherm associated with particular criteria pollutants. The adsorption isotherm defines an equilibrium relationship among various aspects of the sorbents, for example, a temperature of the sorbent and a gas passing through the pollutant capture unit 350, a pressure of the gas passing through the pollutant capture unit 350, a concentration of a particular criteria pollutant in the gas passing through the pollutant capture unit 350, and a concentration of the particular criteria pollutant adsorbed on the sorbent.

In embodiments, the sorbents of the pollutant capture unit 350 may have an equilibrium temperature for each criteria pollutant at which there is no change in the concentration of the criteria pollutant in the gas passing through the pollutant capture unit 350 at a given pressure, that is a temperature at which the particular criteria pollutant is not adsorbed at the given pressure. The equilibrium temperature can be obtained from the adsorption isotherm of each of the criteria pollutants. At temperatures above the equilibrium temperature of a particular criteria pollutant, sorbents of the pollutant capture unit 350 generally release the criteria pollutant. Different criteria pollutants may have different equilibrium temperatures, and as referred to herein, the "desorption temperature" of the pollutant capture unit 350 is a temperature that is greater than at least one of the equilibrium temperatures of the criteria pollutants adsorbed by the pollutant capture unit 350. In embodiments, the amount or rate of a criteria pollutant desorbed by a sorbent of the pollutant capture unit 350 may depend on the temperature of the pollutant capture unit 350. For example, in some embodiments, a rate or amount of a criteria pollutant released by the pollutant capture unit 350 may be higher at temperatures that are comparatively significantly greater the equilibrium temperature of the criteria pollutant, as compared to at temperatures that are comparatively closer to the equilibrium temperature of the criteria pollutant. However, it should be understood that the relationship between the temperature of the pollutant capture unit 350 and the amount or rate of a criteria pollutant released is not necessarily linear. For example, in some embodiments, the amount or rate of a particular criteria pollutant released by the pollutant capture unit 350 may decrease as temperatures continue to increase above the desorption temperature.

In some embodiments, the pollutant capture unit 350 desorbs criteria pollutants at temperatures exceeding 100° C. In some embodiments, the pollutant capture unit 350 desorbs criteria pollutants at temperatures exceeding 150° C. In some embodiments, the pollutant capture unit 350 desorbs criteria pollutants at temperatures exceeding 175° C. In some embodiments, the pollutant capture unit 350 desorbs criteria pollutants at temperatures exceeding 200° C. In some embodiments, the pollutant capture unit 350 desorbs criteria pollutants at temperatures exceeding 220° C. In some embodiments, the pollutant capture unit 350 desorbs criteria pollutants at temperatures between 100° C. and 220° C., inclusive of the endpoints. In some embodiments, the pollutant capture unit 350 desorbs criteria pollutants at temperatures between 150° C. and 220° C., inclusive of the endpoints. Without being bound by theory, the desorption temperature at which the pollutant capture unit 350 desorbs criteria pollutants depends at least in part on the structure and materials of the pollutant capture unit 350.

In embodiments, the structure and materials of the pollutant capture unit 350 are generally selected such that the desorption temperature at which the pollutant capture unit 350 desorbs criteria pollutants is at or below a temperature of exhaust gas that can be preferentially directed to the pollutant capture unit 350 during some operating conditions such as operating conditions other than startup. Further, the structure and materials of the pollutant capture unit 350 are generally selected to endure temperatures of exhaust gas that is preferentially directed to the pollutant capture unit 350 during some operating conditions, such as operating conditions other than startup). For example, in some embodiments, the internal combustion engine system 100 may be configured such that exhaust gas directed to the pollutant capture unit 350 is less than 1000° C. when the exhaust gas reaches the pollutant capture unit 350.

In embodiments, an emission treatment selector valve 130 positioned between the first aftertreatment system 150 and the pollutant capture unit 350 and between the first aftertreatment system 150 and the second aftertreatment system 250. In embodiments, the emission treatment selector valve 130 is positionable in a pollutant capture position, in which the first aftertreatment system 150 and the pollutant capture unit 350 are in communication with one another through the emission treatment selector valve 130.

Figure 3:
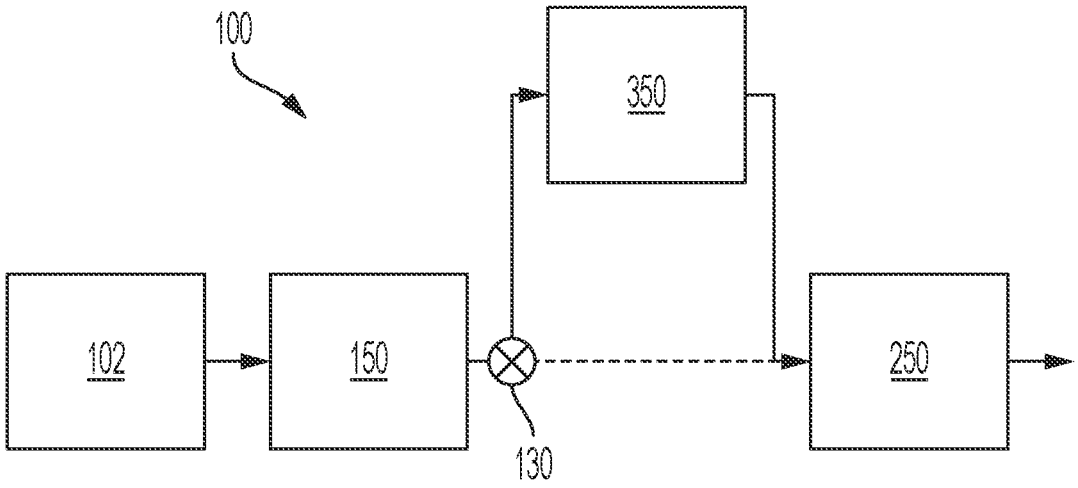
FIG. 3 schematically depicts a process flow of the internal combustion engine system of FIG. 2 in a pollutant capture mode, according to one or more embodiments shown and described herein.

For example and referring to FIGS. 1 and 3, the internal combustion engine system 100 is depicted with the emission treatment selector valve 130 in the pollutant capture position. It is noted that the dashed line of FIG. 3 represents a pathway with closed or reduced flow based on the position of the emission treatment selector valve 130. In operation, a fuel and air mixture is combusted within the combustion chamber 122 of the internal combustion engine 102, thereby forming an exhaust gas. With the emission treatment selector valve 130 in the storage unit position, such as during a startup procedure, the exhaust gas is passed out of the combustion chamber 122 of the internal combustion engine 102, through the first aftertreatment system 150, and to the pollutant capture unit 350 through the emission treatment selector valve 130. During the startup procedure, the pollutant capture unit 350 captures criteria pollutants of the exhaust gas, such that as the exhaust gas passes through the pollutant capture unit 350, the amount of criteria pollutants within the exhaust gas decreases. For example, during a startup procedure, the pollutant capture unit 350 may initially be at an ambient temperature that is below the desorption temperature of the pollutant capture unit 350. Accordingly, although comparatively high temperature exhaust gas is routed to the pollutant capture unit 350 after first passing through the first aftertreatment system 150, during the startup procedure, the pollutant capture unit 350 is below the desorption temperature, and may capture criteria pollutants within the exhaust gas. In some embodiments, greater than 60% of the criteria pollutants that would otherwise be emitted while the first aftertreatment system 150 and the second aftertreatment system 250 are heated to the activation temperature are captured by the pollutant capture unit 350. In various further embodiments, greater than 70%, greater than 75%, greater than 80%, or greater than 90% of the criteria pollutants that would otherwise be emitted while the first aftertreatment system 150 and the second aftertreatment system 250 are heated to the activation temperature are captured by the pollutant capture unit 350.

The exhaust gas is initially passed through the first aftertreatment system 150 upon exit from the combustion chamber 122 of the internal combustion engine 102. As the exhaust gas passes through the first aftertreatment system 150, the exhaust gas heats the first aftertreatment system 150 to the first activation temperature, thereby "lighting off" the one or more catalysts of the first aftertreatment system 150, as described supra. The exhaust gas exiting the first aftertreatment system 150 is then provided to the pollutant capture unit 350. It will be appreciated that providing the exhaust gas to the first aftertreatment system 150 first allows for the exhaust gas to be at maximal temperature after exiting the combustion chamber 122 of the internal combustion engine 102, thus expediting heating of the first aftertreatment system 150 to the first activation temperature. Further, passing the exhaust gas through the first aftertreatment system 150 draws heat away from the exhaust gas allowing for slowed heating of the pollutant capture unit 350.

In various embodiments, "lighting off" the one or more catalysts of the first aftertreatment system 150 occurs 10 to 300 seconds, 20 to 250 seconds, 20 to 200 seconds, 30 to 250 seconds, or 30 to 180 seconds after starting the internal combustion engine 102. It will be appreciated that the time to light off the first aftertreatment system 150 may vary based on the drive cycle and thus the rate of heating.

Figure 4:
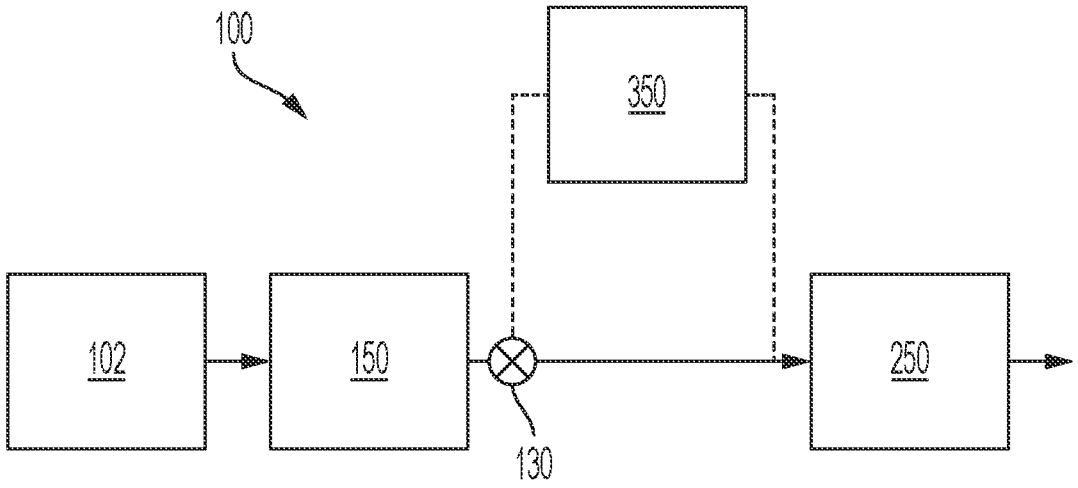
FIG. 4 schematically depicts a process flow of the internal combustion engine system of FIG. 2 in a bypass mode, according to one or more embodiments shown and described herein.

Once the first aftertreatment system 150 is heated to the first activation temperature, the emission treatment selector valve 130 is moved into a bypass position, in which the first aftertreatment system 150 is in communication with the second aftertreatment system 250 through the emission treatment selector valve 130 and the pollutant capture unit 350 is bypassed, as shown in FIG. 4. It is noted that the dashed line of FIG. 4 represents a pathway with closed or reduced flow based on the position of the emission treatment selector valve 130.

In particular, once the first aftertreatment system 150 is heated above the first activation temperature, a secondary procedure is performed. With the emission treatment selector valve 130 in the bypass position, exhaust gas from the combustion chamber 122 of the internal combustion engine 102 is passed to the first aftertreatment system 150 and then directly to the second aftertreatment system 250 through the emission treatment selector valve 130, that is bypassing the pollutant capture unit 350. As the exhaust gas passes through the first aftertreatment system 150 which has reached the first activation temperature, the one or more catalysts of the first aftertreatment system 150 react with criteria pollutants within the exhaust gas, as described supra. In particular, as the exhaust gas passes through the first aftertreatment system 150, the first aftertreatment system 150 reacts with criteria pollutants of the exhaust gas forming a treated exhaust gas which has less criteria pollutants that the exhaust gas passing to the first aftertreatment system 150 from the combustion chamber 122. Further, the exhaust gas from the first aftertreatment system 150 heats the second aftertreatment system 250.

As the exhaust gas passes through the second aftertreatment system 250, the exhaust gas heats the second aftertreatment system 250 to the second activation temperature, thereby "lighting off" the one or more catalysts of the second aftertreatment system 250, as described supra. In various embodiments, "lighting off" the one or more catalysts of the second aftertreatment system 250 occurs 10 to 1,000 seconds, 100 to 1,000 seconds, 200 to 800 seconds, 300 to 600 seconds, 400 to 600 seconds, or 500 to 600 seconds after starting the internal combustion engine 102. It will be appreciated that the time to light off the second aftertreatment system 250 may vary based on the drive cycle and thus the rate of heating. Further, the formulation, the size, and the volume of the one or more catalysts of the second aftertreatment system 250 may also affect the time to light off the second aftertreatment system 250.

Once the second aftertreatment system 250 is heated to the second activation temperature, the emission treatment selector valve 130 is moved into an intermediate position, in which the exhaust gas from the first aftertreatment system 250 is split into a first stream 132 and a second stream 134. The first stream 132 is passing from the first aftertreatment system 150 through the pollutant capture unit 350 to raise the temperature of the sorbent in the pollutant capture unit 350 above a desorption temperature to release the criteria pollutants captured in the pollutant capture unit 350. The second stream 134 is passed directly to the second aftertreatment system 250 along with the exhaust gas from the pollutant capture unit 350. The emission treatment selector valve 130 is variably positionable between the pollutant capture position and the bypass position to provide variably split flow to the pollutant capture unit 350 and the second aftertreatment unit 250.

In one or more embodiments, the temperature of the sorbent in the pollutant capture unit 350 is raised above the desorption temperature for a regeneration period. Specifically, when the sorbent in the pollutant capture unit 350 is above the desorption temperature the criteria pollutants are desorbed and released in the exhaust stream exiting the pollutant capture unit 350. It will be appreciated that the length of the regeneration period is affected by the temperature and flow through the pollutant capture unit 350. Generally, regeneration of the pollutant capture unit 350 takes more time than absorption of the criteria pollutants as there are benefits to regenerating the pollutant capture unit 350 slowly. Specifically, by controlling the flow of exhaust gas through the sorbent with the emission treatment selector valve 130 the second aftertreatment system 250 may be maintained at desirable operating conditions and thus able to efficiently convert the additional criteria pollutants, such as NOx, released from the sorbent. While, in general, a longer regeneration period is desirable it is noted that complete desorption of the criteria pollutants should happen before the internal combustion engine 102 is turned off. Complete desorption of the criteria pollutants before the internal combustion engine 102 is turned off ensures sorbent is cleaned and ready to be used in the next drive cycle. The times we gave in the plot are the best-apparent estimates under these various constraints.

The regeneration period starts when the temperature of the sorbent in the pollutant capture unit 350 reaches the desorption temperature. In various embodiments, the regeneration period lasts 300 to 3,600 seconds, 300 to 3,000 seconds, 300 to 2,000 seconds, 300 to 1,500 seconds, 500 to 1,500 seconds, 500 to 1,200 seconds, or 800 to 1,000 seconds.

As the exhaust gas passes through the second aftertreatment system 250 which has reached the second activation temperature, the one or more catalysts of the second aftertreatment system 250 react with criteria pollutants within the exhaust gas, as described supra. In particular, as the exhaust gas passes through the second aftertreatment system 250, the second aftertreatment system 250 reacts with criteria pollutants of the exhaust gas forming a treated exhaust gas which has less criteria pollutants that the exhaust gas passing to the first aftertreatment system 150 from the combustion chamber 122.

In one or more embodiments, the exhaust gas is also split into the first stream 132 and the second stream 134 when the emission treatment selector valve is positioned in the pollutant capture position. Specifically, in one or more embodiments, flow through the pollutant capture unit 350 is limited during the adsorption of criteria pollutants with the sorbent as increasing the residence time of the exhaust gas inside the sorbent is generally beneficial for maximum storage capacity. For example, providing less flow through the pollutant capture unit 350 provides more time for the sorbent to capture criteria pollutants from the exhaust gas flow.

Figure 5:
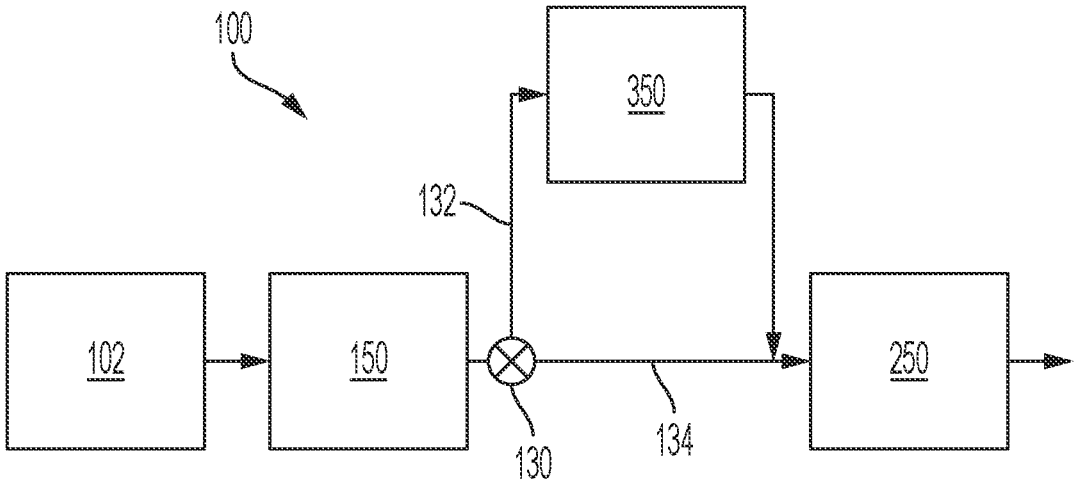
FIG. 5 schematically depicts a process flow of the internal combustion engine system of FIG. 2 in a regeneration mode, according to one or more embodiments shown and described herein.

Subsequent to performing the regeneration procedure as depicted in FIG. 5, the internal combustion engine system 100 may resume operation with the emission treatment selector valve 130 in the bypass position. Specifically, after the regeneration period, the exhaust gas from the first aftertreatment system 150 may be passed directly to the second aftertreatment system 250 without passage through the pollutant capture unit 350 or splitting the exhaust gas from the first aftertreatment system 150 into the first stream 132 and the second stream 134.

Figure 6:
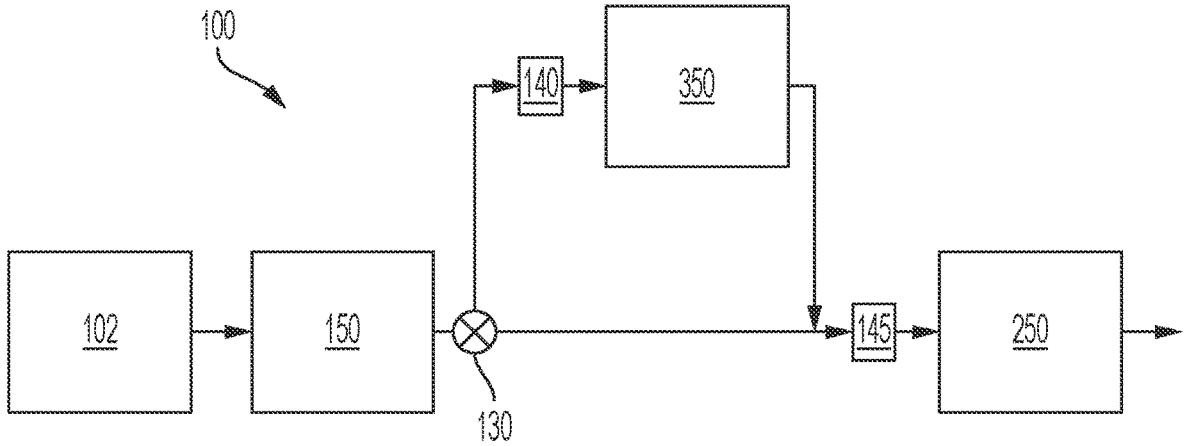
FIG. 6 schematically depicts a process flow of an internal combustion engine system including heating and cooling units, according to one or more embodiments shown and described herein.

Referring to FIG. 6, in some embodiments, the internal combustion engine system 100 includes a cooling unit 140 positioned between the first aftertreatment system 150 and the pollutant capture unit 350. The cooling unit 140 is structurally configured to cool gas passing from the first aftertreatment system 150 to the pollutant capture unit 350. In some embodiments, the cooling unit 140 is a waste heat recovery unit structurally configured to cool gas passing from the first aftertreatment system 150 to the pollutant capture unit 350, and may include for example and without limitation, an electric turbo compound (ETC), a thermoelectric generator (TEG), a Rankine cycle system, or the like. The waste heat recovery unit may assist in recovering thermal energy from the exhaust gas that would otherwise be lost, thereby increasing the efficiency of the internal combustion engine system 100. Further, the waste heat recovery unit may cool the exhaust gas passing from the first aftertreatment system 150 to the pollutant capture unit 350, and may assist in ensuring that exhaust gas passing from the first aftertreatment system 150 to the pollutant capture unit 350 is below the desorption temperature during the startup procedure.

In some embodiments, the cooling unit 140 includes an air cooler or other similar heat exchange system. For example, in some embodiments, the cooling unit 140 dissipates heat from exhaust gas passing through the cooling unit 140 to ambient air surrounding the cooling unit 140, such as by passing ambient air over tubes or pipes carrying the exhaust gas. Similar to embodiments in which the cooling unit 140 is a waste heat recovery unit, the air cooler may assist in ensuring that exhaust gas passing from the first aftertreatment system 150 to the pollutant capture unit 350 is below the desorption temperature. While in the embodiment depicted in FIG. 6, the internal combustion engine system 100 includes a single cooling unit 140, it should be understood that this is merely an example, and the internal combustion engine system 100 may include any suitable number of cooling units 140 positioned between the first aftertreatment system 150 and the pollutant capture unit 350. Further, in embodiments that include multiple cooling units 140, the cooling units 140 may include similar construction, or may include different construction.

By ensuring that the exhaust gas passing from the first aftertreatment system 150 to the pollutant capture unit 350 is below the desorption temperature of the pollutant capture unit 350, the cooling unit 140 may assist in ensuring that criteria pollutants are not released from the pollutant capture unit 350 to the environment. In some embodiments, only a portion of the exhaust gas passing from the first aftertreatment system 150 to the pollutant capture unit 350 is routed through the cooling unit 140, while in some embodiments, all of the exhaust gas passing from the first aftertreatment system 150 to the pollutant capture unit 350 is routed through the cooling unit 140. In some embodiments, ambient air may be introduced to the exhaust gas passing from the first aftertreatment system 150 to the pollutant capture unit 350 to control the temperature of the exhaust gas entering the pollutant capture unit 350, so as to maintain the pollutant capture unit 350 below the desorption temperature.

Referring to FIG. 6, in some embodiments, the internal combustion engine system 100 includes a heating unit 145 positioned between the pollutant capture unit 350 and the second aftertreatment system 250. The heating unit 145 is structurally configured to heat gas entering the second aftertreatment system 250. In one or more embodiments, the heating unit 145 may be an electric heater. In one or more embodiments, the heating unit 145 may operate through combustion of a hydrocarbon. In further embodiments, the heating unit 145 may be a heat exchanger that scavenges heat contained in the exhaust gas or heat contained in the engine oil.

The heating unit 145 may assist in ensuring that exhaust gas passing from the pollutant capture unit 350, or the first aftertreatment system 150, to the second aftertreatment system 250 maintains the second aftertreatment system 250 above the second activation temperature. Specifically, when implemented in conjunction with the cooling unit 140 which cools the exhaust gas before passage through the pollutant capture unit 350, the heating unit 145 elevates the temperature of the exhaust gas to maintain preferred operation of the second aftertreatment system 250 and avoid cooling the second aftertreatment system 250 below the second activation temperature. While in the embodiment depicted in FIG. 6, the internal combustion engine system 100 includes a single heating unit 145, it should be understood that this is merely an example, and the internal combustion engine system 100 may include any suitable number of heating units 145 positioned prior to the second aftertreatment system 250. Further, in embodiments that include multiple heating units 145, the heating units 145 may include similar construction, or may include different construction.

Figure 7:
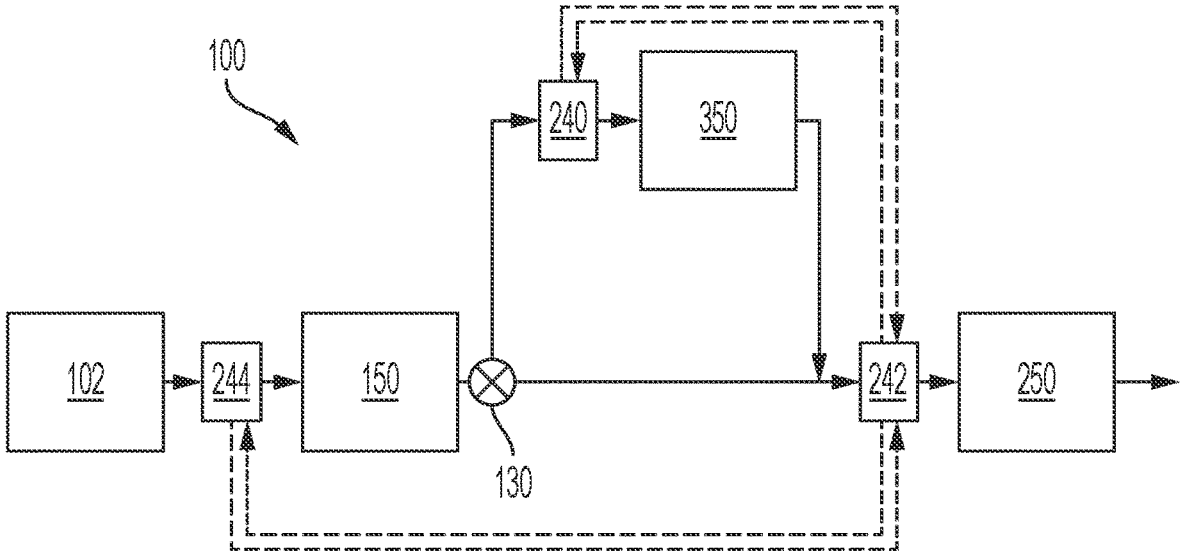
FIG. 7 schematically depicts a process flow of an internal combustion engine system including heat exchanger, according to one or more embodiments shown and described herein.

Referring to FIG. 7, in some embodiments, the internal combustion engine system 100 includes heat exchangers to transfer heat between the exhaust gas at various positions within the internal combustion engine system 100. In one or more embodiments, the internal combustion engine system 100 includes a first heat exchanger 240 positioned between the first aftertreatment system 150 and the pollutant capture unit 350 and a second heat exchanger 242 positioned between the pollutant capture unit 350 and the second aftertreatment system 250. The first heat exchanger 240 is structural configured to cool the exhaust gas from the first aftertreatment system 150 and the second heat exchanger 242 is structurally configured to heat the exhaust gas entering the second aftertreatment system 250.

In one or more embodiments, the internal combustion engine system 100 includes a third heat exchanger 244 positioned between the combustion chamber 122 and the first aftertreatment system 150. The third heat exchanger 244 is structural configured to cool the exhaust gas from the combustion chamber 122. Specifically, the third heat exchanger 244 may transfer heat from the exhaust gas from the combustion chamber 122 to the exhaust gas entering the second aftertreatment system 250.

The first heat exchanger 240, the second heat exchanger 242, and the third heat exchanger 244 may be connected to allow heat transfer between heat exchangers. In one or more embodiments, the first heat exchanger 240 and the second heat exchanger 242 are connected by a closed loop of a thermal transfer medium to transfer heat between the first heat exchanger 240 and the second heat exchanger 242. In one or more embodiments, the third heat exchanger 244 and the second heat exchanger 242 are connected by a closed loop of a thermal transfer medium to transfer heat from the third heat exchanger to the second heat exchanger. In various embodiments, the heat transfer medium provided in the closed loops between heat exchangers may be a liquid or a gas. Example heat transfer mediums include water, glycol solutions, and refrigerants. It is noted that depending on the operating temperatures of the various heat exchangers the heat transfer medium may change from liquid to gas or from gas to liquid during passage through the closed loop.

Figure 8:
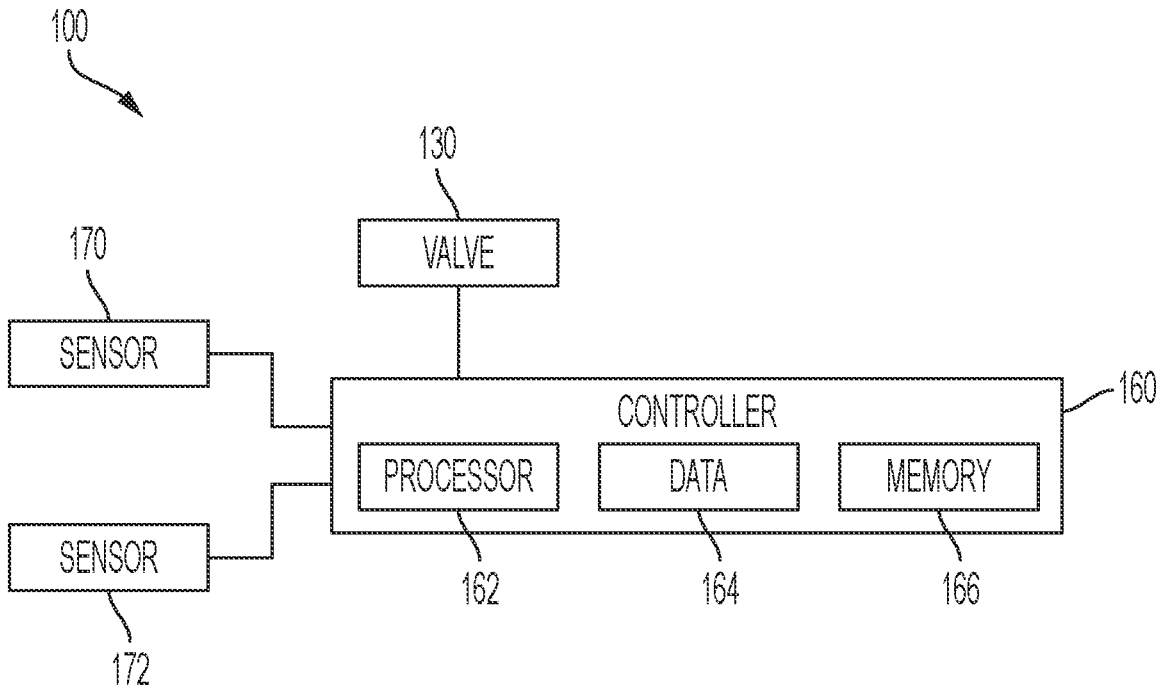
FIG. 8 schematically depicts a control diagram of an internal combustion engine system, according to one or more embodiments shown and described herein.

Referring to FIG. 8, in embodiments, the internal combustion engine system 100 includes a controller 160. As illustrated, the controller 160 includes a processor 162, a data storage component 164, a memory component 166, and their combinations. The memory component 166 may be configured as volatile, nonvolatile, or a combination of volatile and nonvolatile memory and as such, may include random access memory such as SRAM, DRAM, and other types of RAM, flash memory, secure digital (SD) memory, registers, compact discs (CD), digital versatile discs (DVD), other types of non-transitory computer-readable mediums, and their combinations. Depending on the particular embodiment, these non-transitory computer-readable mediums may reside within the controller 160, external to the controller 160, or both within and external to the controller 160.

The memory component 166 may store operating logic, analysis logic, and communication logic in the form of one or more computer readable and executable instruction sets. The analysis logic and the communication logic may each include a plurality of different pieces of logic, each of which may be embodied as a computer program, firmware, hardware, and their combinations, as an example. A local interface is also included in the controller 160, and may be implemented as a bus or other communication interface to facilitate communication among the components of the controller 160.

The processor 162 may include any processing component operable to receive and execute instructions such as from a data storage component 164 or the memory component 166. It should be understood that while the components in FIG. 8 are illustrated as residing within the controller 160, this is merely an example, and in some embodiments, one or more of the components may reside external to the controller 160. It should also be understood that, while the controller 160 is illustrated as a single device, this is also merely an example.

In embodiments, the controller 160 is communicatively coupled to one or more components of the internal combustion engine system 100. For example, in the embodiment depicted in FIG. 8, the controller 160 is communicatively coupled to the aftertreatment-storage unit valve 130, and in embodiments, the controller 160 directs the aftertreatment-storage unit valve 130 to move between the pollutant capture position (FIG. 3) and the bypass position (FIG. 4).

In some embodiments, the controller 160 is communicatively coupled to the emission treatment selector valve 130. The controller 160 may direct the emission treatment selector valve 130 to move between open and closed positions to direct exhaust gas from the combustion chamber 122 (FIG. 1) through the internal combustion engine system 100 described above and as depicted in FIGS. 2 through 7.

In some embodiments, the internal combustion engine system 100 further includes a first aftertreatment system temperature sensor 170 and a second aftertreatment system temperature sensor 172 communicatively coupled to the controller 160. The first aftertreatment system temperature sensor 170 is structurally configured to detect a temperature of the first aftertreatment system 150 (FIG. 2), and may send a signal to the controller 160 indicative of a detected temperature of the first aftertreatment system 150 (FIG. 2). Similarly, the second aftertreatment system temperature sensor 172 is structurally configured to detect a temperature of the second aftertreatment system 250 (FIG. 2), and may send a signal to the controller 160 indicative of a detected temperature of the second aftertreatment system 250 (FIG. 2). The detected temperature of the first aftertreatment system 150 (FIG. 2) may be utilized to determine when to change from the startup procedure (FIG. 3) to the secondary procedure (FIG. 4) by moving the emission treatment selector valve 130 from the pollutant capture position to the bypass position. Similarly, the detected temperature of the second aftertreatment system 250 (FIG. 2) may be utilized to determine when to change from the secondary procedure (FIG. 4) to 5) by moving the emission treatment selector valve 130 from the bypass position to an arrangement splitting flow from the first aftertreatment system 150 between the pollutant capture unit 350 and the second aftertreatment system 250.

In embodiments, the controller 160 determines whether the detected temperature of the first aftertreatment system 150 exceeds the first activation temperature of the first aftertreatment system 150. In response to determining that the detected temperature of the first aftertreatment system 150 (FIG. 2) exceeds the first activation temperature, the controller 160 directs the emission treatment selector valve 130 to move into the bypass position (FIG. 4). As discussed above, with the emission treatment selector valve 130 in the bypass position (FIG. 4), exhaust gas is routed from the combustion chamber 122 (FIG. 1) of the internal combustion engine 102 (FIG. 1) to the first aftertreatment system 150 and then directly to the second aftertreatment system 250 in accordance with the arrangement of FIG. 4. In response to determining that the detected temperature of the first aftertreatment system 150 is less than the first activation temperature, the controller 160 directs the emission treatment selector valve 130 to remain in or move to the pollutant capture position (FIG. 3). As discussed above, with the emission treatment selector valve 130 in the pollutant capture position (FIG. 3), exhaust gas from the combustion chamber 122 (FIG. 1) is directed to the first aftertreatment system 150 and then to the pollutant capture unit 350 (FIG. 3), such that the pollutant capture unit 350 may capture criteria pollutants while the first aftertreatment system 150 is heated.

In embodiments, the controller 160 determines whether the detected temperature of the second aftertreatment system 250 exceeds the second activation temperature of the second aftertreatment system 250. In response to determining that the detected temperature of the second aftertreatment system 250 (FIG. 2) exceeds the second activation temperature, the controller 160 directs the emission treatment selector valve 130 to move into an arrangement where the exhaust gas from the first aftertreatment system 150 is split into the first stream 132 and the second stream 134 (FIG. 5). As discussed above, with the emission treatment selector valve 130 in an intermediate position between the bypass position and the pollutant capture position, exhaust gas is routed from the combustion chamber 122 (FIG. 1) of the internal combustion engine 102 (FIG. 1) to the first aftertreatment system 150 and then split into the first stream 132 and the second stream 134 with the first stream 132 passed through the pollutant capture unit 350 and the second stream 134 passed directly to the second aftertreatment system 250. Passing a controlled portion of the exhaust gas from the first aftertreatment system 150 through the pollutant capture unit 350 raises the temperature of the sorbent in the pollutant capture unit 350 above the desorption temperature to release the criteria pollutants captured in the pollutant capture unit 350. As the second aftertreatment system 250 has reached the second activation temperature, the second aftertreatment system 250 is able to handle the increased flow of criteria pollutants resulting from the desorption of the criteria pollutants from the pollutant capture unit 350.

Figure 9:
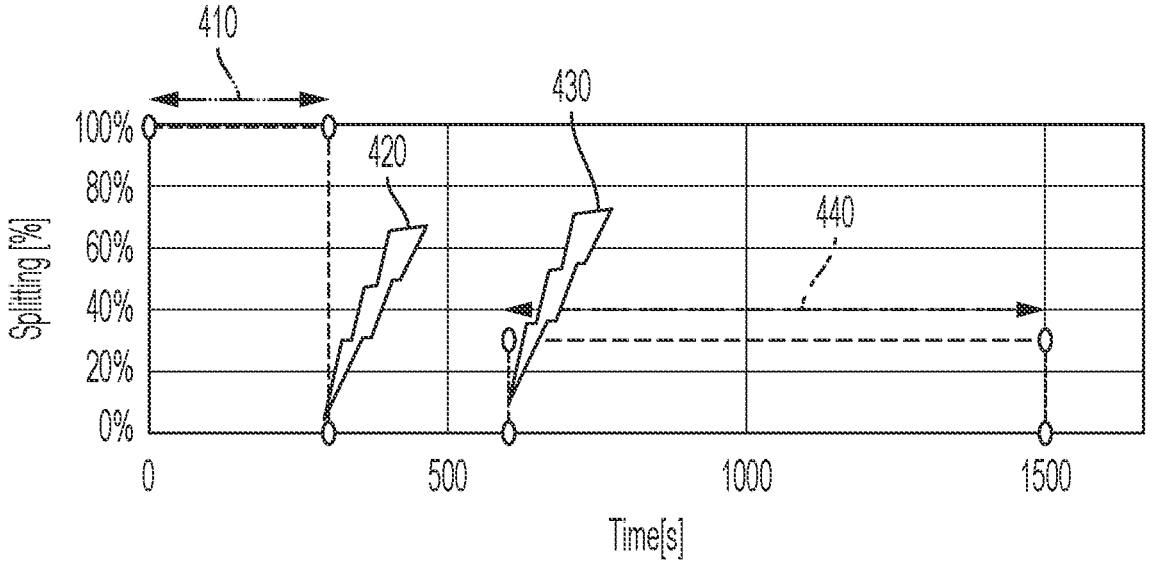
FIG. 9 illustrates flow splitting to achieve intermittent flow through a sorbent, according to one or more embodiments shown and described herein.

With reference to FIG. 9, the sequence of operation of the internal combustion engine system 100 illustrated. During a pollutant storage period 410 the emission treatment selector valve 130 is positioned with 100% of flow to the pollutant capture unit 350 (FIG. 3). Upon reaching light-off 420 of the first aftertreatment system 150 the emission treatment selector valve 130 is adjusted such that 0% of flow is to the pollutant capture unit 350, thereby directing 100% of flow directly to the second aftertreatment system 250 (FIG. 4). The flow to the second aftertreatment system 250 heats the second aftertreatment system 250 until light-off 430 of the second aftertreatment system 250. Upon light-off 430 of the second aftertreatment system 250 the emission treatment selector valve 130 is adjusted to split flow between the pollutant capture unit 350 and directly to the second aftertreatment system 250 (FIG. 5). For example, as illustrated in FIG. 9, the emission treatment selector valve 130 may be positioned with only 30% of flow to the pollutant capture unit 350 with the remaining 70% directly to the second aftertreatment system 250. Passage through the pollutant capture unit 350 heats the sorbent in the pollutant capture unit 350 above the desorption temperature releasing the captured criteria pollutants which may be treated in the second aftertreatment system 250 downstream of the pollutant capture unit 350. After a regeneration period 440, approximately 900 seconds in FIG. 9, the emission treatment selector valve 130 is adjusted such that 100% of flow is directed to the second aftertreatment system 250 for continued operation of the internal combustion engine 102.

Figure 10:
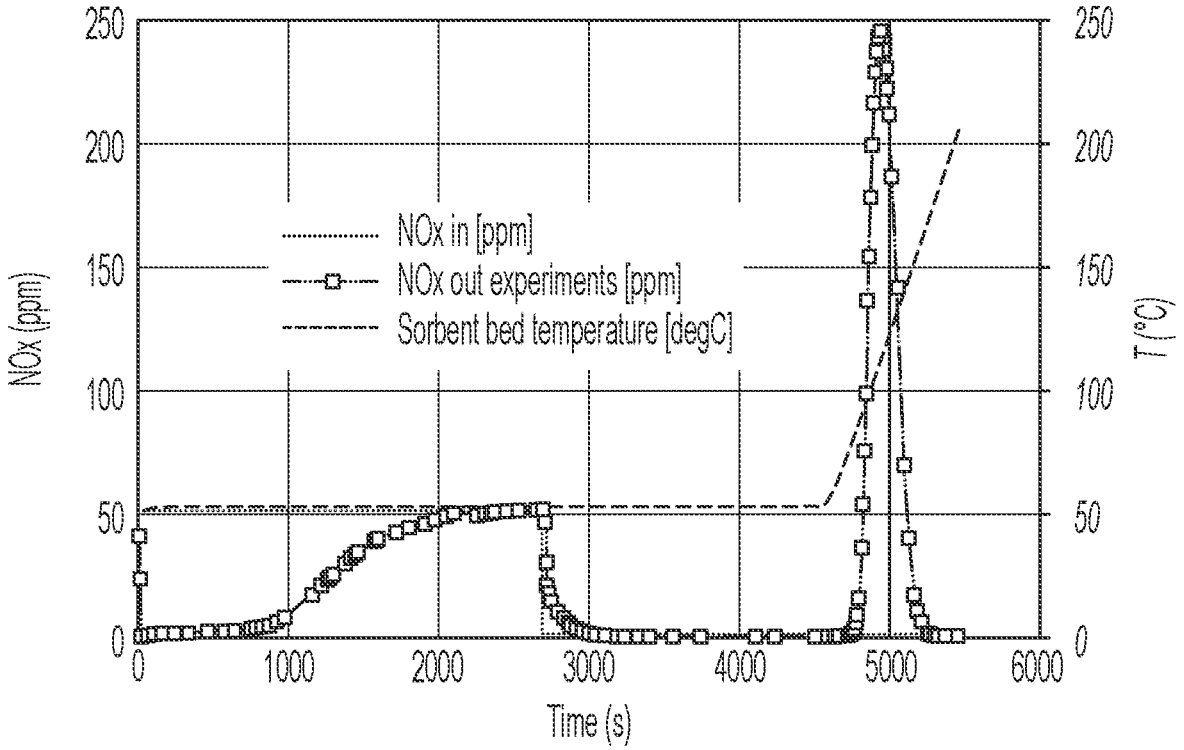
FIG. 10 graphically illustrates adsorption and desorption of NOx in a sorbent bed according to one or more embodiments shown and described herein.

With reference to FIG. 10, the adsorption and desorption of criteria pollutants by the sorbent in the pollutant capture unit 350 is illustrated. Specifically, 50 parts per million (ppm) of NOx in nitrogen was passed through a sorbent material. The sorbent used was 13X, which is an alumina silicate bead. It may be observed that the sorbent initially captures all the NOx with diminishing capture, as noted by increasing NOx exiting the example pollutant capture unit 350, over time as the sorbent becomes saturated. However, once flow of NOx to the sorbent is terminated at approximately 2,800 seconds the exhausting of NOx is also stopped indicating that the sorbent effectively retains captured NOx when operated below the desorption temperature. Further, as the sorbent temperature is increased, starting at approximately 4,600 seconds, the desorption of the NOx is noted. Specifically, a sharp spike in the amount of NOx exhausted from the example pollutant capture unit 350 is demonstrated followed by a sharp decrease as all the adsorbed NOx is depleted. Such demonstrates the ability to controllable adsorb and desorb NOx, and other criteria pollutants, within a sorbent material of the pollutant capture unit 350.

It should now be understood the various aspects of the method for operating an internal combustion engine and associated internal combustion engine system are described and such aspects may be utilized in conjunction with various other aspects.

According to a first aspect, a method for operating an internal combustion engine includes combusting a fuel and air mixture within a combustion chamber of an internal combustion engine, thereby forming an exhaust gas; passing the exhaust gas out of the combustion chamber; performing a startup procedure, the startup procedure comprising: passing the exhaust gas from the combustion chamber to a first aftertreatment system comprising one or more catalysts, passing the exhaust gas from the first aftertreatment system to a pollutant capture unit comprising one or more sorbent materials, capturing criteria pollutants of the exhaust gas with the pollutant capture unit, passing the exhaust gas from the pollutant capture unit to a second aftertreatment system comprising one or more catalysts, where the one or more catalysts in the first aftertreatment system may be the same or different from the one or more catalysts in the second aftertreatment system, and heating the first aftertreatment system to a first activation temperature with the exhaust gas from the combustion chamber; subsequent to heating the first aftertreatment system to the first activation temperature, performing a secondary procedure, the secondary procedure comprising: passing the exhaust gas from the first aftertreatment system directly to the second aftertreatment system without passage through the pollutant capture unit, and heating the second aftertreatment system to a second activation temperature with the exhaust gas from the first aftertreatment system; and subsequent to heating the second aftertreatment system to the second activation temperature, performing a tertiary procedure, the tertiary procedure comprising: splitting the exhaust gas from the first aftertreatment system into a first stream and a second stream, passing the first stream of the exhaust gas from the first aftertreatment system through the pollutant capture unit to raise the temperature of the sorbent above a desorption temperature for a regeneration period to release the criteria pollutants captured in the pollutant capture unit, and passing the second stream of the exhaust gas from the first aftertreatment system and the exhaust gas from the pollutant capture unit to the second aftertreatment system; wherein, the one or more catalysts of the first aftertreatment system upon reaching the first activation temperature and the one or more catalysts of the second aftertreatment system upon reaching the second activation temperature react with criteria pollutants of the exhaust gas, thereby forming a treated exhaust gas, wherein the treated exhaust gas comprises less criteria pollutants than the exhaust gas from the combustion chamber.

A second aspect includes the method of the first aspect in which the tertiary procedure further comprises: after the regeneration period, passing the exhaust gas from the first aftertreatment system directly to the second aftertreatment system without passage through the pollutant capture unit or splitting the exhaust gas from the first aftertreatment system into the first stream and the second stream.

A third aspect includes the method of the first or second aspect in which the one or more catalysts in the first aftertreatment system are the same as the one or more catalysts in the second aftertreatment system.

A fourth aspect includes the method of the first or second aspect in which the one or more catalysts in the first aftertreatment system are different from the one or more catalysts in the second aftertreatment system.

A fifth aspect includes the method of any of the first through fourth aspects in which the startup procedure further comprises, prior to passing the exhaust gas from the first aftertreatment system to the pollutant capture unit, cooling the exhaust gas.

A sixth aspect includes the method of the fifth aspect in which cooling the exhaust gas from the first aftertreatment system comprises passing the exhaust gas from the first aftertreatment system through a cooling unit.

A seventh aspect includes the method of the sixth aspect in which the cooling unit comprises at least one of an air cooler and a waste heat recovery unit comprising at least one of an electric turbo compound, a thermoelectric generator, and a Rankine cycle system.

An eighth aspect includes the method of any of the first through seventh aspects in which the startup procedure further comprises, prior to passing the exhaust gas from the pollutant capture unit to the second aftertreatment system, heating the exhaust gas.

A ninth aspect includes the method of the eighth aspect in which heating the exhaust gas from the pollutant capture unit comprises passing the exhaust gas from the pollutant capture unit through a heating unit.

A tenth aspect includes the method of any of the first through ninth aspects in which the startup procedure further comprises: cooling the exhaust gas from the first aftertreatment system with a first heat exchanger positioned between the first aftertreatment system and the pollutant capture unit, and heating the exhaust gas entering the second aftertreatment system with a second heat exchanger positioned between the pollutant capture unit and the second aftertreatment system, wherein the first heat exchanger and the second heat exchanger are connected by a closed loop of a thermal transfer medium.

An eleventh aspect includes the method of the tenth aspect in which the secondary procedure further comprises: cooling the exhaust gas from the combustion chamber with a third heat exchanger positioned between the combustion chamber and the first aftertreatment system, and heating the exhaust gas entering the second aftertreatment system with the second heat exchanger, wherein the third heat exchanger and the second heat exchanger are connected by a closed loop of the thermal transfer medium.

A twelfth aspect includes the method of any of the first through eleventh aspects in which the criteria pollutants comprise at least one of carbon monoxide, nitrogen oxides, and hydrocarbons.

According to a thirteenth aspect, an internal combustion engine system includes a combustion chamber; a pollutant capture unit in selective communication with the combustion chamber, wherein the pollutant capture unit comprises one or more sorbent materials structurally configured to capture one or more criteria pollutants in a gas passing through the pollutant capture unit; a first aftertreatment system comprising one or more catalysts in communication with the combustion chamber and in selective communication with the pollutant capture unit, wherein the first aftertreatment system is structurally configured to react with one or more criteria pollutants in a gas passing through the first aftertreatment system; a second aftertreatment system comprising one or more catalysts in selective communication with the pollutant capture unit and the first aftertreatment system, wherein the second aftertreatment system is structurally configured to react with one or more criteria pollutants in a gas passing through the second aftertreatment system, and wherein the one or more catalysts in the first aftertreatment system may be the same or different from the one or more catalysts in the second aftertreatment system; an emission treatment selector valve positioned between the first aftertreatment system and the pollutant capture unit and between the first aftertreatment system and the second aftertreatment system, wherein the emission treatment selector valve is repositionable between a pollutant capture position, in which the first aftertreatment system and the pollutant capture unit are in communication with one another through the emission treatment selector valve, and a bypass position, in which the first aftertreatment system is in communication with the second aftertreatment system through the emission treatment selector valve; and a controller communicatively coupled to the emission treatment selector valve, the controller comprising a processor and a computer readable and executable instruction set, which when executed, causes the processor to: execute a startup procedure, the startup procedure comprising: directing the emission treatment selector valve into the pollutant capture position, thereby directing exhaust gas from the first aftertreatment system to the pollutant capture unit; execute a secondary procedure, the secondary procedure comprising: directing the emission treatment selector valve into the bypass position, thereby directing exhaust gas from the first aftertreatment system to the second aftertreatment system bypassing the pollutant capture unit; and execute a tertiary procedure, the tertiary procedure comprising: directing the emission treatment selector valve to direct the exhaust gas from the first aftertreatment system at least partially to the pollutant capture unit to raise the temperature of the sorbent materials above a desorption temperature to release the criteria pollutants captured in the pollutant capture unit.

A fourteenth aspect includes the system of the thirteenth aspect in which the emission treatment selector valve is variably positionable between the pollutant capture position and the bypass position to provide variably split flow to the pollutant capture unit and the second aftertreatment unit.

A fifteenth aspect includes the system of the thirteenth or fourteenth aspect in which the system further comprises a first aftertreatment system temperature sensor communicatively coupled to the controller, wherein the first aftertreatment system temperature sensor is structurally configured to detect a temperature of the first aftertreatment system.

A sixteenth aspect includes the system of the fifteenth aspect in which the computer readable and executable instruction set, when executed, further causes the processor to: receive a signal from the first aftertreatment system temperature sensor indicative of a detected temperature of the first aftertreatment system; and determine whether the detected temperature of the first aftertreatment system exceeds a first activation temperature; wherein directing the emission treatment selector valve to move into the bypass position is in response to determining that the temperature of the first aftertreatment system exceeds the first activation temperature.

A seventeenth aspect includes the system of any of the thirteenth through sixteenth aspects in which the system further comprises a second aftertreatment system temperature sensor communicatively coupled to the controller, wherein the second aftertreatment system temperature sensor is structurally configured to detect a temperature of the second aftertreatment system.

An eighteenth aspect includes the system of the seventeenth aspect in which the computer readable and executable instruction set, when executed, further causes the processor to: receive a signal from the second aftertreatment system temperature sensor indicative of a detected temperature of the second aftertreatment system; and determine whether the detected temperature of the second aftertreatment system exceeds a second activation temperature; wherein directing the emission treatment selector valve to direct the exhaust gas from the first aftertreatment system at least partially to the pollutant capture unit is in response to determining that the temperature of the second aftertreatment system exceeds the second activation temperature.

A nineteenth aspect includes the system of any of the thirteenth through eighteenth aspects in which the system further comprises a cooling unit positioned between the first aftertreatment system and the pollutant capture unit, wherein the cooling unit is structurally configured to cool gas passing from the first aftertreatment system to the pollutant capture unit.

A twentieth aspect includes the system of the nineteenth aspect in which the cooling unit comprises at least one of an air cooler and a waste heat recovery unit comprising at least one of an electric turbo compound, a thermoelectric generator, and a Rankine cycle system.

A twenty-first aspect includes the system of any of the thirteenth through twentieth aspect in which the system further comprises a heating unit positioned between the pollutant capture unit and the second aftertreatment system, wherein the heating unit is structurally configured to heat gas entering the second aftertreatment system.

A twenty-second aspect includes the system of any of the thirteenth through twenty-first aspect in which the system further comprises a first heat exchanger positioned between the first aftertreatment system and the pollutant capture unit, the first heat exchanger structural configured to cool the exhaust gas from the first aftertreatment system, and a second heat exchanger positioned between the pollutant capture unit and the second aftertreatment system, the second heat exchanger structurally configured to heat the exhaust gas entering the second aftertreatment system, wherein the first heat exchanger and the second heat exchanger are connected by a closed loop of a thermal transfer medium.

A twenty-third aspect includes the system of the twenty-second aspect in which the system further comprises a third heat exchanger positioned between the combustion chamber and the first aftertreatment system, the third heat exchanger structural configured to cool the exhaust gas from the combustion chamber, wherein the third heat exchanger and the second heat exchanger are connected by a closed loop of the thermal transfer medium to transfer heat from the third heat exchanger to the second heat exchanger.

Having described the subject matter of the present disclosure in detail and by reference to specific embodiments, it is noted that the various details described in this disclosure should not be taken to imply that these details relate to elements that are essential components of the various embodiments described in this disclosure, even in cases where a particular element is illustrated in each of the drawings that accompany the present description. Rather, the appended claims should be taken as the sole representation of the breadth of the present disclosure and the corresponding scope of the various embodiments described in this disclosure. Further, it should be apparent to those skilled in the art that various modifications and variations can be made to the described embodiments without departing from the spirit and scope of the claimed subject matter. Thus it is intended that the specification cover the modifications and variations of the various described embodiments provided such modification and variations come within the scope of the appended claims and their equivalents.

It is noted that recitations herein of a component of the present disclosure being "structurally configured" in a particular way, to embody a particular property, or to function in a particular manner, are structural recitations, as opposed to recitations of intended use. More specifically, the references herein to the manner in which a component is "structurally configured" denotes an existing physical condition of the component and, as such, is to be taken as a definite recitation of the structural characteristics of the component.

It is noted that terms like "preferably," "commonly," and "typically," when utilized herein, are not utilized to limit the scope of the claimed invention or to imply that certain features are critical, essential, or even important to the structure or function of the claimed invention. Rather, these terms are merely intended to identify particular aspects of an embodiment of the present disclosure or to emphasize alternative or additional features that may or may not be utilized in a particular embodiment of the present disclosure.

The singular forms "a", "an" and "the" include plural referents, unless the context clearly dictates otherwise.

For the purposes of describing and defining the present invention it is noted that the terms "substantially" and "about" are utilized herein to represent the inherent degree of uncertainty that may be attributed to any quantitative comparison, value, measurement, or other representation. The terms "substantially" and "about" are also utilized herein to represent the degree by which a quantitative representation may vary from a stated reference without resulting in a change in the basic function of the subject matter at issue.

Throughout this disclosure ranges and explicit values are provided. It is envisioned that each discrete value encompassed by the ranges are also included. Additionally, the ranges which may be formed by each discrete value encompassed by the explicitly disclosed ranges are equally envisioned. For brevity, the same is not explicitly indicated subsequent to each disclosed range and the present general indication is provided.

It is noted that one or more of the following claims utilize the term "wherein" as a transitional phrase. For the purposes of defining the present invention, it is noted that this term is introduced in the claims as an open-ended transitional phrase that is used to introduce a recitation of a series of characteristics of the structure and should be interpreted in like manner as the more commonly used open-ended preamble term "comprising."

What is claimed is:

1. A method for operating an internal combustion engine, the method comprising:

combusting a fuel and air mixture within a combustion chamber of an internal combustion engine, thereby forming an exhaust gas;

passing the exhaust gas out of the combustion chamber;

performing a startup procedure, the startup procedure comprising:

passing the exhaust gas from the combustion chamber to a first aftertreatment system comprising one or more catalysts;

cooling the exhaust gas from the first aftertreatment system with a first heat exchanger positioned between the first aftertreatment system and a pollutant capture unit;

passing the exhaust gas from the first aftertreatment system to the pollutant capture unit comprising one or more sorbent materials;

capturing criteria pollutants including carbon monoxide, nitrogen oxides, and unburnt hydrocarbons of the exhaust gas with the pollutant capture unit;

passing the exhaust gas from the pollutant capture unit to a second aftertreatment system comprising one or more catalysts, where the one or more catalysts in the first aftertreatment system may be the same or different from the one or more catalysts in the second aftertreatment system;

heating the exhaust gas entering the second aftertreatment system with a second heat exchanger positioned between the pollutant capture unit and the second aftertreatment system, wherein the first heat exchanger and the second heat exchanger are connected by a closed loop of a thermal transfer medium; and heating the first aftertreatment system to a first activation temperature with the exhaust gas from the combustion chamber;

subsequent to heating the first aftertreatment system to the first activation temperature, performing a secondary procedure, the secondary procedure comprising:

passing the exhaust gas from the first aftertreatment system directly to the second aftertreatment system without passage through the pollutant capture unit; and heating the second aftertreatment system to a second activation temperature with the exhaust gas from the first aftertreatment system; and subsequent to heating the second aftertreatment system to the second activation temperature, performing a tertiary procedure, the tertiary procedure comprising:

splitting the exhaust gas from the first aftertreatment system into a first stream and a second stream;

passing the first stream of the exhaust gas from the first aftertreatment system through the pollutant capture unit to raise the temperature of the sorbent above a desorption temperature for a regeneration period to release the criteria pollutants captured in the pollutant capture unit; and passing the second stream of the exhaust gas from the first aftertreatment system and the exhaust gas from the pollutant capture unit to the second aftertreatment system;

wherein, the one or more catalysts of the first aftertreatment system upon reaching the first activation temperature and the one or more catalysts of the second aftertreatment system upon reaching the second activation temperature react with criteria pollutants of the exhaust gas, thereby forming a treated exhaust gas, wherein the treated exhaust gas comprises less criteria pollutants than the exhaust gas from the combustion chamber.

2. The method of claim 1, wherein the tertiary procedure further comprises:

after the regeneration period, passing the exhaust gas from the first aftertreatment system directly to the second aftertreatment system without passage through the pollutant capture unit or splitting the exhaust gas from the first aftertreatment system into the first stream and the second stream.

3. The method of claim 1, wherein the one or more catalysts in the first aftertreatment system are the same as the one or more catalysts in the second aftertreatment system.

4. The method of claim 1, wherein the one or more catalysts in the first aftertreatment system are different from the one or more catalysts in the second aftertreatment system.

5. The method of claim 1, wherein the startup procedure further comprises, prior to passing the exhaust gas from the first aftertreatment system to the pollutant capture unit, cooling the exhaust gas.

6. The method of claim 5, wherein cooling the exhaust gas from the first aftertreatment system comprises passing the exhaust gas from the first aftertreatment system through a cooling unit.

7. The method of claim 1, wherein the startup procedure further comprises, prior to passing the exhaust gas from the pollutant capture unit to the second aftertreatment system, heating the exhaust gas.

8. The method of claim 1, wherein the secondary procedure further comprises:

cooling the exhaust gas from the combustion chamber with a third heat exchanger positioned between the combustion chamber and the first aftertreatment system, and heating the exhaust gas entering the second aftertreatment system with the second heat exchanger, wherein the third heat exchanger and the second heat exchanger are connected by a closed loop of the thermal transfer medium.

9. The method of claim 1, wherein the criteria pollutants comprise at least one of carbon monoxide, nitrogen oxides, and hydrocarbons.

10. An internal combustion engine system comprising:

a combustion chamber;

a pollutant capture unit in selective communication with the combustion chamber, wherein the pollutant capture unit comprises one or more sorbent materials structurally configured to capture criteria pollutants including carbon monoxide, nitrogen oxides, and unburnt hydrocarbons in a gas passing through the pollutant capture unit;

a first aftertreatment system comprising one or more catalysts in communication with the combustion chamber and in selective communication with the pollutant capture unit, wherein the first aftertreatment system is structurally configured to react with one or more criteria pollutants in a gas passing through the first aftertreatment system;

a second aftertreatment system comprising one or more catalysts in selective communication with the pollutant capture unit and the first aftertreatment system, wherein the second aftertreatment system is structurally configured to react with one or more criteria pollutants in a gas passing through the second aftertreatment system, and wherein the one or more catalysts in the first aftertreatment system may be the same or different from the one or more catalysts in the second aftertreatment system;

a first heat exchanger positioned between the first aftertreatment system and the pollutant capture unit, the first heat exchanger structural configured to cool the exhaust gas from the first aftertreatment system;

a second heat exchanger positioned between the pollutant capture unit and the second aftertreatment system, the second heat exchanger structurally configured to heat the exhaust gas entering the second aftertreatment system, wherein the first heat exchanger and the second heat exchanger are connected by a closed loop of a thermal transfer medium;

an emission treatment selector valve positioned between the first aftertreatment system and the pollutant capture unit and between the first aftertreatment system and the second aftertreatment system, wherein the emission treatment selector valve is repositionable between a pollutant capture position, in which the first aftertreatment system and the pollutant capture unit are in communication with one another through the emission treatment selector valve, and a bypass position, in which the first aftertreatment system is in communication with the second aftertreatment system through the emission treatment selector valve; and a controller communicatively coupled to the emission treatment selector valve, the controller comprising a processor and a computer readable and executable instruction set, which when executed, causes the processor to:

execute a startup procedure, the startup procedure comprising directing the emission treatment selector valve into the pollutant capture position, thereby directing exhaust gas from the first aftertreatment system to the pollutant capture unit;

execute a secondary procedure, the secondary procedure comprising directing the emission treatment selector valve into the bypass position, thereby directing exhaust gas from the first aftertreatment system to the second aftertreatment system bypassing the pollutant capture unit; and execute a tertiary procedure, the tertiary procedure comprising directing the emission treatment selector valve to direct the exhaust gas from the first aftertreatment system at least partially to the pollutant capture unit to raise the temperature of the sorbent materials above a desorption temperature to release the criteria pollutants captured in the pollutant capture unit.

11. The internal combustion engine system of claim 10, wherein the emission treatment selector valve is variably positionable between the pollutant capture position and the bypass position to provide variably split flow to the pollutant capture unit and the second aftertreatment unit.

12. The internal combustion engine system of claim 10, further comprising a first aftertreatment system temperature sensor communicatively coupled to the controller, wherein the first aftertreatment system temperature sensor is structurally configured to detect a temperature of the first aftertreatment system.

13. The internal combustion engine system of claim 12, wherein the computer readable and executable instruction set, when executed, further causes the processor to:

receive a signal from the first aftertreatment system temperature sensor indicative of a detected temperature of the first aftertreatment system; and determine whether the detected temperature of the first aftertreatment system exceeds a first activation temperature;

wherein directing the emission treatment selector valve to move into the bypass position is in response to determining that the temperature of the first aftertreatment system exceeds the first activation temperature.

14. The internal combustion engine system of claim 10, further comprising a second aftertreatment system temperature sensor communicatively coupled to the controller, wherein the second aftertreatment system temperature sensor is structurally configured to detect a temperature of the second aftertreatment system.

15. The internal combustion engine system of claim 14, wherein the computer readable and executable instruction set, when executed, further causes the processor to:

receive a signal from the second aftertreatment system temperature sensor indicative of a detected temperature of the second aftertreatment system; and determine whether the detected temperature of the second aftertreatment system exceeds a second activation temperature;

wherein directing the emission treatment selector valve to direct the exhaust gas from the first aftertreatment system at least partially to the pollutant capture unit is in response to determining that the temperature of the second aftertreatment system exceeds the second activation temperature.

16. The internal combustion engine system of claim 10, further comprising a cooling unit positioned between the first aftertreatment system and the pollutant capture unit, wherein the cooling unit is structurally configured to cool gas passing from the first aftertreatment system to the pollutant capture unit.

17. The internal combustion engine system of claim 10, further comprising a heating unit positioned between the pollutant capture unit and the second aftertreatment system, wherein the heating unit is structurally configured to heat gas entering the second aftertreatment system.

18. The internal combustion engine system of claim 10, further comprising:

a third heat exchanger positioned between the combustion chamber and the first aftertreatment system, the third heat exchanger structural configured to cool the exhaust gas from the combustion chamber, wherein the third heat exchanger and the second heat exchanger are connected by a closed loop of the thermal transfer medium to transfer heat from the third heat exchanger to the second heat exchanger.

* * * * *